United States Patent [19]

Arlt et al.

[11] Patent Number: 5,017,839

[45] Date of Patent: May 21, 1991

[54] ILLUMINATION SYSTEM HAVING A LOW-POWER HIGH-PRESSURE DISCHARGE LAMP AND POWER SUPPLY COMBINATION

[75] Inventors: Joachim Arlt, Munich; Alexander Dobrusskin, Taufkirchen; Jürgen Von Scheidt, Berlin; Jürgen Heider, Munich, all of Fed. Rep. of Germany

[73] Assignee: Patent-Treuhand Gesellschaft fur Elektrische Gluhlampen m.b.H, Munich, Fed. Rep. of Germany

[21] Appl. No.: 452,125

[22] Filed: Dec. 15, 1989

[30] Foreign Application Priority Data

Dec. 19, 1988 [DE] Fed. Rep. of Germany ..... 3842771

[51] Int. Cl.[5] ..... H05B 41/00

[52] U.S. Cl. ..... 315/219; 315/82; 315/220; 315/326; 315/DIG. 7; 313/572

[58] Field of Search ..... 315/82, 83, 219, 220, 315/222, 326, DIG. 7; 313/110, 570, 571, 572, 573, 574, 575, 576, 627, 634, 635, 636, 637, 638, 639, 640, 641, 642

[56] References Cited

U.S. PATENT DOCUMENTS 4,717,852 1/1988 Dobrusskin et al. ..... 313/634 X
4,757,236 7/1988 Dakin et al. ..... 313/638
4,891,555 1/1990 Ahlgren et al. ..... 313/634
4,935,668 6/1990 Hausler et al. ..... 313/634 X

FOREIGN PATENT DOCUMENTS 8623908 5/1988 Fed. Rep. of Germany .
3719356 12/1988 Fed. Rep. of Germany .
3719357 12/1988 Fed. Rep. of Germany .

*Primary Examiner*—David Mis
*Attorney, Agent, or Firm*—Frishauf, Holtz, Goodman & Woodward

[57] ABSTRACT

To shorten the time between firing of a high-pressure discharge lamp and substantial light output therefrom, the discharge lamp includes a fill of xenon, at a cold fill pressure of at least 3 bar, in addition to mercury and a metal halide; the discharge vessel (2) is, at least in part, coated or doped so that invisible radiation is reflected into the lamp, or absorbed, while visible radiation is being transmitted by the discharge vessel. The shafts of the electrodes are thin, of only about 0.3 mm diameter, and the electrodes facing each other are part-spherical or rounded. The lamp is operated in combination with a lamp power supply (S) which has the characteristics of being capable of supplying between 5 to 10 times normal operating current of the lamp under starting conditions.

21 Claims, 4 Drawing Sheets

ILLUMINATION SYSTEM HAVING A LOW-POWER HIGH-PRESSURE DISCHARGE LAMP AND POWER SUPPLY COMBINATION

Reference to related application, assigned to the assignee of the present application, the disclosure of which is hereby incorporated by reference:

U.S. Ser. No. 07/452,221, filed Dec. 15, 1989, Heider et al.

Reference to related publications, assigned to the assignee of the present application:

German Utility Model GM 86 23 908

German Patent Disclosure Document DE-OS 37 19 356, Arlt

German Patent Disclosure Document DE-OS 37 19 357, Arlt.

The present invention relates to an illumination system using a discharge lamp in combination with a power supply capable of supplying current for starting conditions vastly in excess of the operating current requirements of the lamp, and more particularly to such lamps and power supply combinations suitable for use in automotive vehicles, energized from direct current supplies, e.g. in the order of between 12 to 24 V, in which the lamps are suitable for vehicle headlight illumination and have extremely short turn-on intervals.

BACKGROUND

High-pressure discharge lamps, and particularly such lamps having a metal halide fill are used more and more for general service illumination. Another use of these lamps is for headlights in automotive vehicles. The power requirements for lamps of either application is usually below 70 W. 35 W is entirely sufficient for headlight illumination. Automotive lamps must be so designed that maximum available light is obtained practically instantaneously after closing of the power supply switch. High-pressure discharge lamps, while being extremely efficient for illumination, have the disadvantage that some starting time is required until the lamp, after first ignition, provides a high output light flux. In conventionally operated lamps, such starting time may be in the order of about 40 seconds.

German Utility Model Publication DE-GM 86 23 908 proposes a solution to shorten the starting time. External heat is supplied in order to vaporize the fill within the lamp, and retain it under vaporized condition. The increased temperature, and hence the increased pressure, permitted shortening time, that is, the time after closing of the main power supply switch, to only about 8 seconds. This, still, is too long for automotive headlight use, and the external heating of the lamp requires additional electrical energy. This increases the installation, the terminal constructions, and does not entirely solve the problem of fast light output response of the lamp. For many uses, the delay between switch operation and high light output is still too long.

THE INVENTION

It is an object to provide an illumination system, that is, a lamp and power supply combination in which the time to obtain substantial light output from the lamp is shortened and which does not require continuous external heating.

Briefly, the lamp construction itself can be essentially conventional in that a pair of electrode lead-ins, with electrodes at the end, spaced from each other and defining a discharge space, are passed through end press seals of a discharge vessel. The fill, typically, includes at least one noble gas, optionally mercury, and a metal halide, for example a sodium-rare earth metal halide or a sodium-scandium halide. The mass, in grams, of the discharge vessel can be very low, for example between about 0.002 to 0.1 g/W of the nominal power rating of the lamp.

In accordance with the invention, the power supply is capable of delivering between 5 to 10 times the nominalrated current under starting conditions; and the lamp fill includes xenon as the noble gas at a cold fill pressure of at least 3 bar. The discharge vessel is transparent, at least in part, to visible light; it can be coated or include elements which reflect non-visible radiation, or absorb it, transmitting only visible radiation. The electrode shafts are small, that is, they have a diameter of at most about 0.3 mm. The electrodes themselves have rounded, for example part-spherical tips facing each other.

The power supply is an electronic power supply which is so constructed that it can control the starting or ignition current between lamp ignition and the final light flux output within a range of preferably up to 10 times of nominal rated current, during run-up conditions of the lamp.

The power supply in combination with a prior art lamp has the advantage that the time until about 90% of light flux is obtained is reduced from the time taken by a conventionally energized metal-halide high-pressure discharge lamp of about 30 seconds to 5 seconds and less. Using the lamp in accordance with the present invention in combination with such a power supply, the time can be reduced to only about 1 second, if the lamp, in accordance with a feature of the present invention, is suitably coated or doped, the fill of the discharge vessel is appropriately selected as above set forth, and control of the run-up or starting current is possible up to the maximum permissible limit of operation of the electronic power supply.

The lamp—supply combination of the invention, with respect to a conventional combination, can shorten the run-up or starting time by a factor of about 30. The high excess current during the starting phase heats the mass of the discharge vessel, which is optimized in accordance with the present invention, so fast that the required operating conditions are immediately obtained. The resulting heat is reflected due to suitable doping of the material of the discharge vessel and/or coating of the discharge vessel, so that heat will be reflected internally of the discharge vessel or absorbed thereby. Radiated heat from the discharge vessel thus is reduced, and heat losses can be minimized. The heat which is gained with respect to conventional metal-halide lamps can then be used entirely for vaporization of the fill and thus shortens the run-up time to a surprising and substantial extent. Using xenon in the fill causes a high proportion of light availability instantaneously as soon as ignition or discharge of the lamp has started.

DRAWINGS

FIG. 1 is a schematic illustration of the system and showing the metal-halide lamp including a reflecting coating thereon;

FIG. 2*a* and 2*b* show operating characteristics;

FIG. 3 shows the light flux with respect to time with a controlled electronic power supply, in which the lamp has a reflective coating and includes xenon in the fill; and FIG. 4 is a circuit diagram of a power supply capable of energizing the lamp.

DETAILED DESCRIPTION

Figure 1:
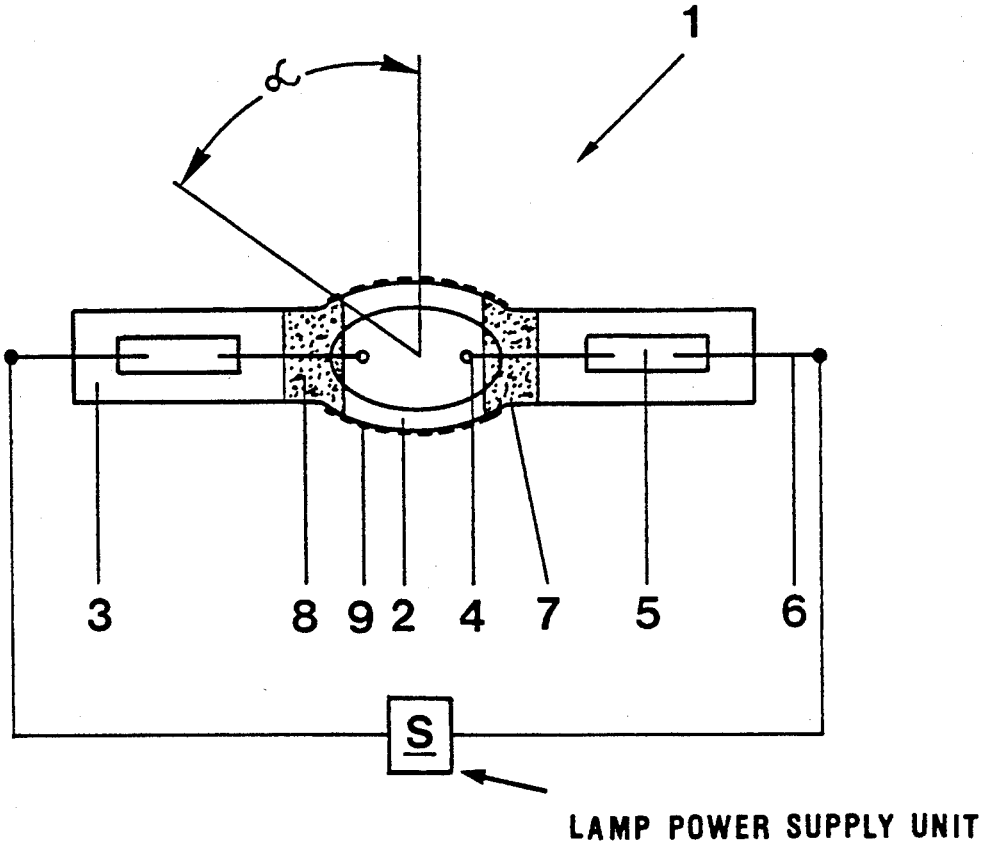

A metal-halide high-pressure discharge lamp 1, see FIG. 1, has a discharge vessel 2 of quartz glass. The lamp is a double-ended lamp, and two pinch or press seals 3 are provided, through which conventional current supply leads 6, connected to molybdenum foils 5 are sealed. As seen in FIG. 1, the lamp does not need an outer envelope. The molybdenum foils 5, embedded in the press seals 3, are connected to tungsten electrodes 4.

The electrode tips are essentially spherical, having a sphere diameter of about 0.35 mm, located at the ends of tungsten wires of about 0.18 mm diameter. The molybdenum foils 5 have a surface of about 10 $mm^2$.

The discharge vessel 2 is of essentially elliptical cross section, and has, for a metal-halide high-pressure discharge lamp of about 35 W power, an outer diameter of about 5.5 mm, and a length between the ends of the elliptical vessel, shown at 7 in FIG. 1, of about 7 mm. The mass of the discharge vessel 2 is about 6 mg per watt, in the present case, for a 35 W lamp, thus about 0.2 g. The volume within the discharge vessel is only about 0.025 $cm^3$. The fill contains mercury, argon as a starting gas, as well as the halides of sodium and preferably of scandium or of sodium and of a rare earth metal. At the end portions 7, that is, the region of transition from the discharge vessel 2 to the press seals 3, a coating 8 of silicon iron oxide is applied and, thereabove, a further layer of zirconium dioxide. The lateral axis of the lamp and a connection line between the center of the discharge vessel and the inner edge of the coating forms an angle $\alpha$ which, preferably, is between about 50° and 55°. The coating 8 thus quite well covers the space behind the electrodes 4. In operation, these spaces are thus preferentially heated. The transparent part or portion of the discharge vessel is coated with a dichroic coating 9 of titanium dioxide and silicon dioxide having a layer thickness of about 0.2 $\mu$m. This coating transmits visible radiation, but reflects infrared (IR) radiation.

The electrodes 4 are spherical at the surface facing each other.

It is further possible to dope the quartz glass with a doping which absorbs ultraviolet (UV) radiation. A suitable doping is titanium dioxide, present in about 0.02% to 0.2% (by weight).

In the specific example shown in FIG. 1, the quartz glass was not doped, and the fill did not include xenon.

Figure 2A:
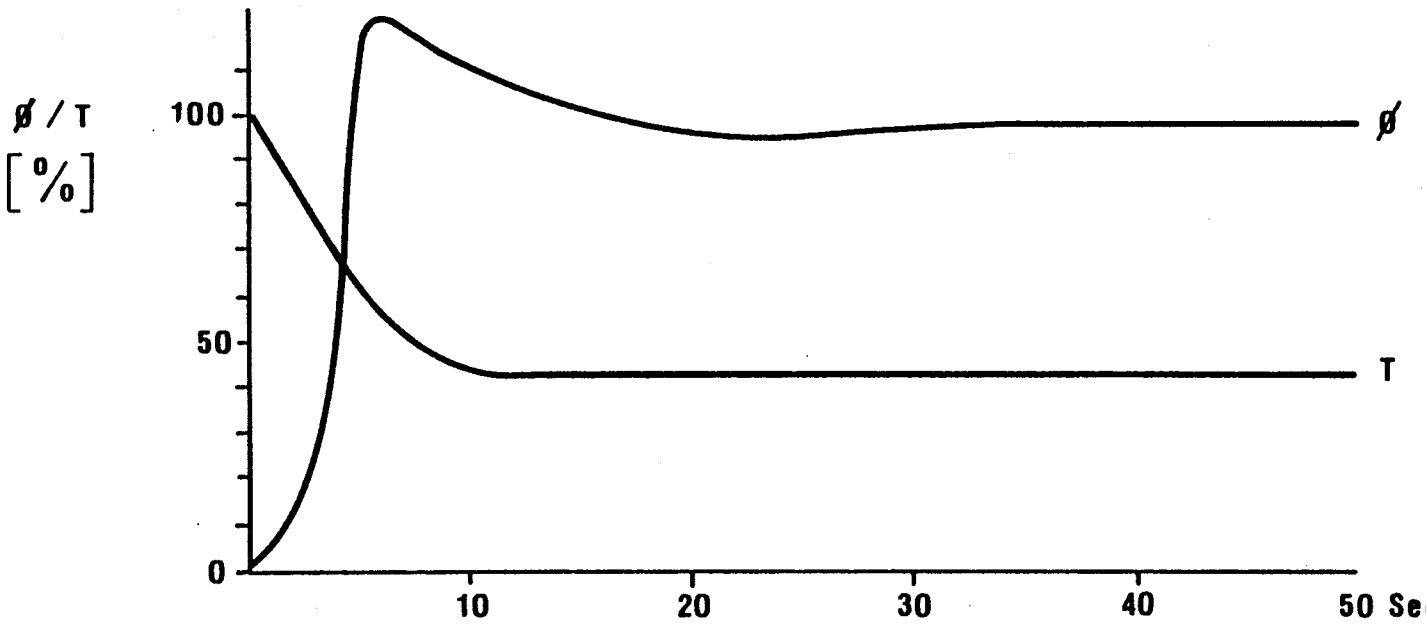

A lamp, as shown in FIG. 1, was constructed, but without any of the coatings 8 and 9, and without doping the quartz glass discharge vessel, and without using a xenon fill. The lamp was operated with a power supply, controlling firing and run-up current, to be described below. The run-up current of the lamp was about 2.6 A, which corresponds to about 6.5 times nominal rated current of the lamp 1. Under such conditions, about 30% of the light flux $\phi$ occurs about 3 seconds after firing; 50% light flux is available after about 3.8 seconds, and 90% of the light flux $\phi$ at about 4.5 seconds. The rise in light output from the lamp, see FIG. 2*a*, is rapid and the curve is steep. After about 5 seconds, it exceeds the nominal rated light output, rising to about 120% of nominal light to then drop after about 15 seconds to nominal light output.

Figure 2B:
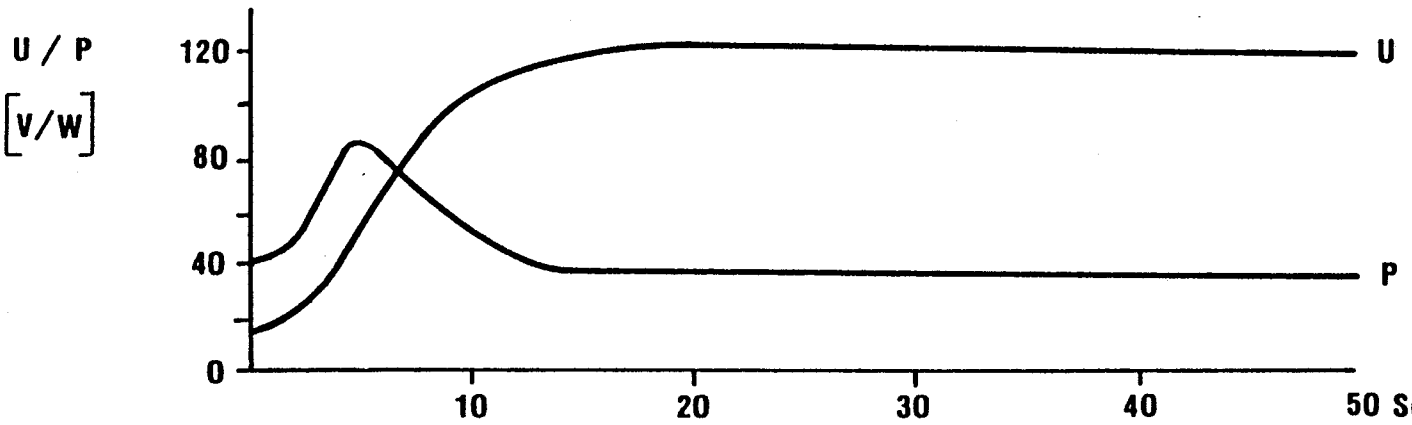

The curve T of FIG. 2*a* shows color temperature with respect to run-up time, and FIG. 2*b* shows operating voltage U of the lamp in volts, and operating power P in watts. The operating characteristics vs. time diagrams are self-explanatory.

Figure 3:
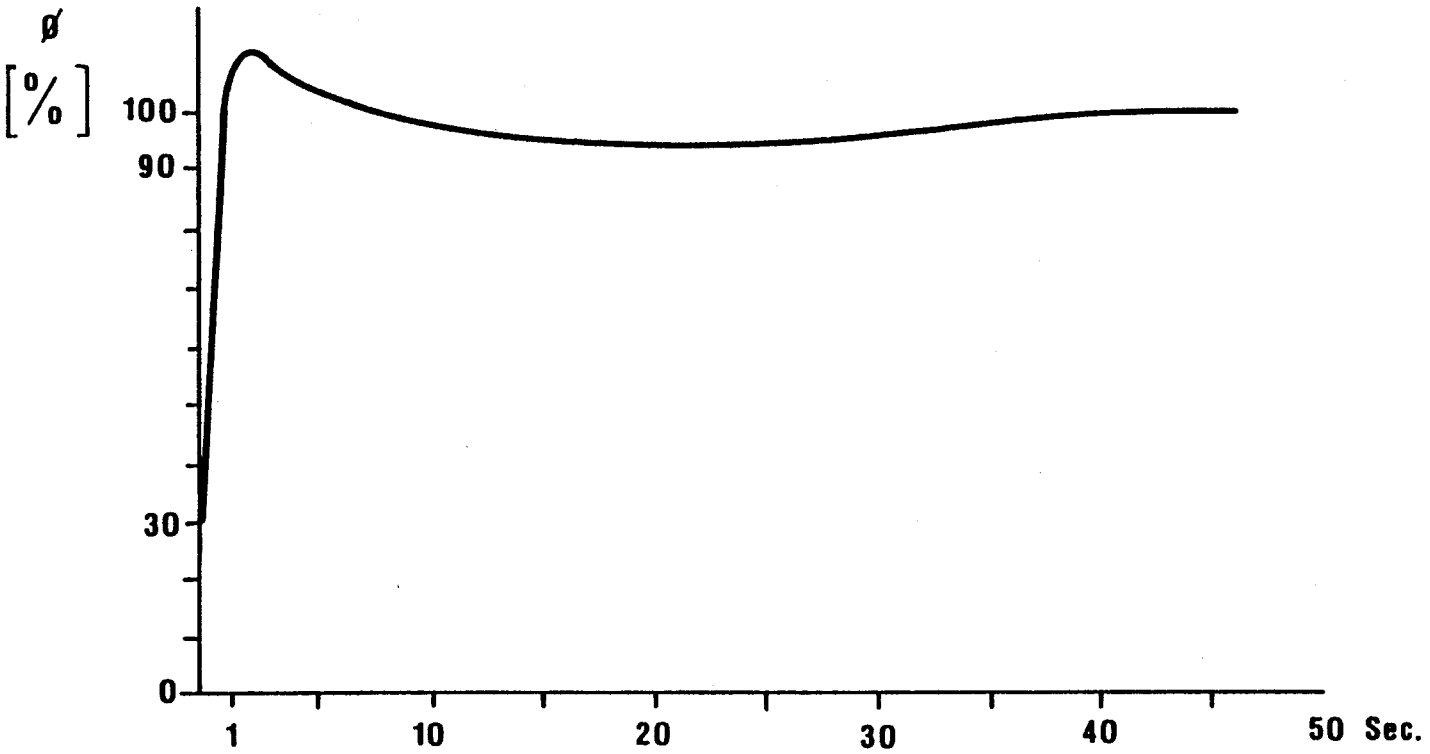

Changing the lamp construction by including xenon in the fill and optionally providing coating, substantially improves the light output characteristics of the lamp. FIG. 3 illustrates the light output curve, with respect to time, of the lamp of FIG. 1, which is a metal-halide high-pressure discharge lamp. This lamp did not have the coating 9; the discharge vessel included xenon in the fill, the xenon having been introduced at a cold fill pressure of about 6 bar. The lamp, as in the example of the lamp with the characteristics of FIGS. 2*a* and 2*b*, is operated from the electronic power supply S, in which the starting current is 3.3 A, which corresponds to about 8.5 times nominal rated current. As can be seen from the diagram of FIG. 3, the light flux increases even more rapidly with an output curve which is even steeper than that of the light flux curve of FIG. 2*a*. 90% of usable light flux $\phi$ is reached after only about 1 second. This extremely short run- up or starting time can be reduced even more if, in accordance with the embodiment illustrated in FIG. 1 the quartz glass is doped with titanium dioxide or cesium dioxide ($CeO_2$) and/or the lamp, additionally, has the coatings 8 and/or 9 applied thereto.

Figure 4:
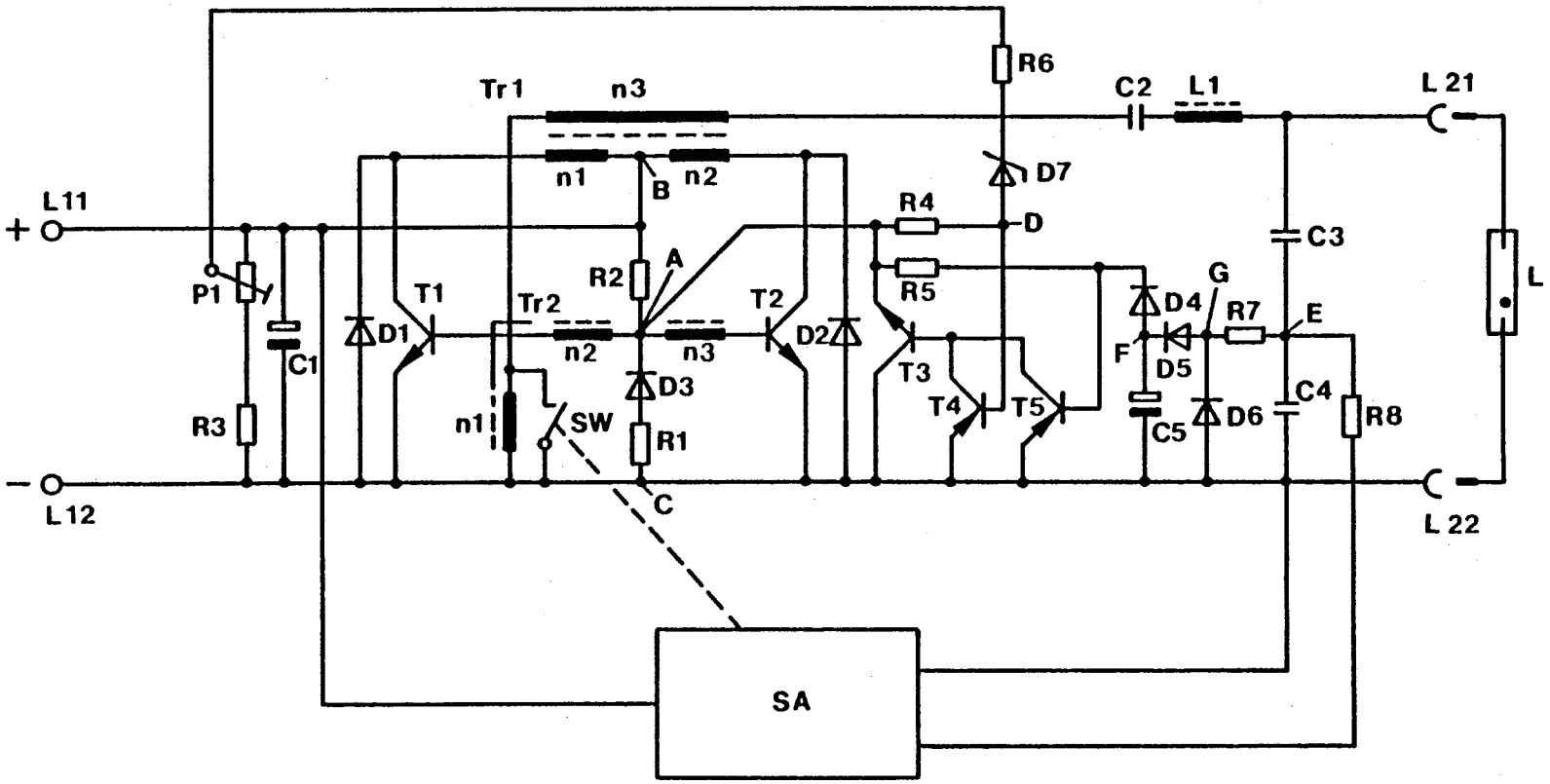

FIG. 4 illustrates a suitable power supply which can be connected by terminals L11 and L12 to an automative battery, for example of 12 V. The lamp L which can, for example, be identical to the lamp described in connection with FIG. 1, has its lead-in wires 6 connected to lamp connector terminals L21 and L22 At terminals L21 and L22, lamp operating voltage of about 100 V will be available, supplied from the original 12 V d-c source.

The high-pressure metal-halide discharge lamps have a substantial tolerance to lamp voltages, for example of ±10 V. Within such a range, the influence on lamp power of the circuit is comparatively low, that is, less than about 2%. Thus, and in view of widely varying voltages available from automotive batteries, the lamps are suitable for automotive headlight or illumination use, if the lamp current can be maintained reasonably constant and sufficiently high under starting conditions. The circuit is frequency-dependent with respect to the impedance of the lamp circuit. Lamp current varies with lamp operating power frequency. The ignition and light output characteristics of high-pressure discharge lamps suitable for vehicular use are frequency-independent within a wide range. Thus, suitable control of power being supplied to the lamp is readily possible.

The circuit provides for frequency change in the output circuit by changing the time constant of the control circuit of a push-pull inverter. The time constants are determined by the relationship of reactance to effective resistance in the control circuits.

FIG. 4 is the circuit diagram of an inverter for high-frequency operation of a metal-halide high-pressure discharge lamp L, such as lamp 1 of FIG. 1, from a low-voltage d-c source, lines L11 and L12. The circuit, basically, is a transistor circuit to stabilize lamp power upon change in operating voltage and a further transistor control circuit to provide high run-up or starting current.

Basically, the circuit has two rapidly switching power transistors T1 and T2. The collectors of transistors T1, T2 are connected over respective primary windings n1, n2 of a power transformer Tr1 to a center tap B of the power transformer primary winding. The emitters of the transistors T1, T2 are connected to the negative terminal L12 of the d-c source. The bases of the transistors are connected through secondary windings n2, n3 of a control transformer Tr2 to a center tap A thereof, which, in turn, is connected over a diode D3 and a series resistor R1 with the negative line L12. A coupling resistor R2 connects center tap A to the positive line L11. The center tap B between the primary windings n1 and n2 of the power transformer Tr1 is also connected to the positive line L11.

Diodes D1, D2, connected in blocking direction, are coupled across the emitter-collector paths, respectively, of transistors T1, T2. The control circuits of the thus described push-pull oscillator include the secondary windings n2, n3 of the control transformer Tr2 and the base-emitter paths of the respective transistors T1, T2. Common to both control circuits is the diode D3 and the resistor R1. A smoothing capacitor C1 is connected across the lines L11 and L12.

A series resonance circuit formed by capacitor C3 and inductance or choke L1 is provided. A d-c blocking capacitor C2 separates d-c from the series resonance circuit. The secondary winding n3 of the power transformer Tr1 and the primary winding n1 of the control transformer Tr2 are likewise serially connected to the series resonance circuit. The three windings n1, n2, n3 of the control transformer Tr2 are secured to a common toroidal core.

Upon switching ON a power of, for example, 12 V across lines L11 and L12, current will flow through resistor R2 and windings n2, n3 of the control transformer Tr2, which will result in a small positive current in the bases of the switching transistors T1, T2 which, then, will become conductive. The dissymetries of the transistors T1, T2 result in capacitative shift currents in the resonance capacitor C3 of the output circuit. These currents flow over the primary winding n1 of the control transformer Tr2 and cause, via the control windings n2, n3, alternate conduction and blocking of the transistors T1, T2. The control transformer Tr2 is magnetically separated or isolated from the power transformer Tr1. Thus, the frequency determining characteristics of the control portion are largely uninfluenced by the dimensions of the power transformer Tr1 and the current conditions in the output circuit. Thus, suitable constancy of output frequency is obtained, which is desirable for operation of high-pressure discharge lamps.

The control circuit resistor R1 should be as low ohmic as possible. On the other hand, only a small current flowing over the resistor R2 should still be able to provide the necessary base voltage at the center tap A to start self-oscillations. To provide for these respective conditions, the junction A is separated from the resistor Rl by the diode D3.

The lamp power, upon changes in operating voltages, is stabilized by a stabilization circuit which includes an npn transistor T3, the emitter of which is connected to the center tap A of the control transformer Tr2. The collector of transistor T3 is connected to the negative line L12. A resistor R3 and a series potentiometer P1 are connected across lines L11, L12. The slider of the potentiometer Pl is connected to a resistor R6 and then to a Zener diode D7 and to a junction D. The junction D is connected through a resistor R4 to the emitter of transistor T3 and hence, to the center tap A of the control transformer Tr2. The collector-emitter path of a pnp transistor T4 is connected across the base-collector path of transistor T3. The emitter of transistor T4 is connected to the negative line L12. The base of transistor T4 is connected to the junction D between the resistor R4 and the Zener diode D7.

The control currents in the control circuits are so directed that a negative voltage occurs at the center tap A, with respect to the ground or L12 junction or terminal C, which, also, forms the common connection point for the emitters of transistor T1, T2. A negative current flows from the center tap A over resistor R4 into the base of the pnp transistor T4, so that transistor T4 as well as transistor T3 become conductive. This will result in setting the operating frequency to be comparatively low, and a low resonance circuit impedance and a correspondingly high output current is obtained. The resistor R4 is so selected that at the lowest expected operating voltage, the output power is still within the permitted tolerance range. If the voltage across terminals L11, L12 rises, increase in output current is prevented by increasing the frequency and hence increasing output impedance. The negative base current from the center tap A through resistor R4 is decreased by a positive current, depending on operating voltage through resistor R6 and Zener diode D7, and coupled to the junction D. When the negative current through resistor R4 is exactly compensated, both transistor T3 and T4 are blocked, and the frequency has its highest level. The Zener voltage of the diode D7 is so selected that the smallest occurring operating voltage causes current to flow through the resistor R6. The potentiometer P1 can be adjusted to set the appropriate output power.

The circuit includes further features to increase the run-up current Transistors T1, T2 are the basic oscillator transistors, and transistors T3, T4 are provided to ensure stable supply of power to the lamp L. The transistor T3 has a further function, in combination with the transistor T5. Like transistor T4, it is connected across the base-collector path of the transistor T3. The base of the transistor T5 is coupled through a resistor R5 to the center tap A of the control transformer Tr2. Additionally, the base of the transistor T5 is coupled over a diode D4, a diode D5, and a resistor R7 with a junction E, between the resonance capacitor C3 and a further capacitor C4, A junction F between diodes D4 and D5 is connected through a capacitor C5 to the negative bus C, that is, to line L12. A junction G between diode D5 and resistor R7 is coupled via diode D6 to the negative bus C.

Increased run-up current for starting of the lamp is obtained by changing the time constant of the control circuit; thus, basically, again the output of the circuit is controlled by changing the time constant of the control circuits, similar to the stabilization of the lamp power upon change in operating voltage. Change of the time constant is obtained in the control circuits by changing the resistance of the parallel connected transistor T3. To effect such a change, a negative current is coupled over resistor R5 from the center tap A into the base of the transistor T5, so that transistor T5, and with it transistor T3, will become conductive. The level of the run-up current can be adjusted by suitable selection of the resistance value of the resistor R5.

Stabilization of lamp power based on input voltage is disabled when the increased run-up current control takes over. This is obtained automatically, since the substantially higher control base current in the transistor T3 iva transistor T5 suppresses or overrides the control effect of the transistor T4.

The high lamp run-up current is gradually decreased, which is obtained from a negative base current of the transistor T5, that is, by overcompensating this negative base current by a positive current derived from a voltage divider formed by the two capacitors C3, C4. The alternating current, which arises at the capacitative voltage divider C3, C4, is rectified by the diodes D5, D6, smoothed by capacitor C5, and is coupled via diode D4 in form of a positive current into the base circuit of the transistor T5. During ordinary operation of the lamp, the diode D4 separates the two currents so that the control of the lamp current is unambiguous, that is, either based on input voltage across lines L11, L12 or starting conditions. When the positive current on the voltage divider C3, C4 has the same value as the negative current over resistor R5, transistor T5 is controlled into blocking condition, and the increased run-up current is disconnected. This, then, releases transistor T4 for control of lamp current and lamp power, essentially independent, within a tolerance range, of the voltage across lines L11, L12.

If the lamp L or, in FIG. 1, lamp 1, becomes defective, is removed, while the circuit is ON, from the lamp sockets, or there is a line break, the circuit may become overloaded, by building up, inherently, excessive loss power. Such high loading may lead to damage or destruction of circuit components. To disconnect the circuit and inhibit oscillation, a safety accessory circuit SA is provided, to furnish a "safety-OFF" signal. The safety accessory SA, which is not shown specifically, includes a disconnect circuit. It receives, as control voltage, a voltage tapped off from junction E via resistor R8, to provide some time delay. This control voltage, across the capacitor C4 with the time delay as determined by the value of resistor R8, controls a relay circuit which, in turn, controls operation of a switch SW short-circuiting the control winding n1 of control transformer Tr2, thus inhibiting oscillations and, in effect, changing the operating conditions of the respective components to a quiescent minimum current. Switch S, of course, can also be differently located.

A 35 W metal halide high-pressure discharge lamp operating circuit with a nominal lamp voltage of 100 V, supplied from an incoming voltage L11, L12 of 12 V, had the following components:

| | |
|---|---|
| C1 | 1000 μF |
| T1, T2 | 4 each × BUV 26, parallel connected |
| Tr1 | ferrite core E 36, n1 = 8 Wd, n2 = 8 Wd, n3 = 118 Wd(Wd = windings) |
| Tr2 | toroidal core, n1 = 13 Wd, n2 = 7 Wd, n3 = 7 Wd |
| R1 | 2.2 Ω |
| R2, R3, R5 | 2.2 kΩ |
| D1, D2 | RGP 30 |
| D3 | BY 255 |
| C2 | 33 nF |
| L1 | 12 mH |
| C3 | 1.4 nF |
| P1 | 1 kΩ |
| R7 | 1.8 kΩ |
| R4 | 4.7 kΩ |
| C4 | 33 nF |
| T3 | BD 139 |
| T4, T5 | BC 327 |
| R6 | 18 kΩ |
| D7 | ZPD 9.1 |
| D4 | 3 × 1 N 4148 serially connected |

-continued

| | |
|---|---|
| D5, D6 | 1 N 4148 |
| C5 | 4.7 μF |
| R8 | 1 MΩ |

Under resonance conditions, a sinusoidal alternating voltage of about 18 kV peak to peak at a frequency of about 45 kHz will obtain, which causes ignition of the metal halide high- pressure discharge lamp L, or lamp 1, at a time shorter than 6 ms. Dependent on the value of the resonance capacity, an effective current of about 2.5 A will flow in the resonance circuit. Providing a lamp starting current of about 2 A permits a 35 W metal halide high-pressure discharge lamp to reach about 60% of maximum light current within about 5 seconds. Increasing the lamp current under starting conditions even further, as described in connection with FIGS. 2*a* and 2*b*, reduces the time until substantial light output is available from the lamp. By combining the circuit described with the lamp which has xenon in the fill gas, with a cold fill pressure of at least 3 bar; providing reflection or absorption for non-visible radiation components of the emitted radiation from the lamp; and providing electrode shafts internally of the discharge vessel of minimum size, for example maximum 0.3 mm diameter, increased rapidity of high light output, as described in connection with FIG. 3 is obtained.

The control circuit is so arranged that the primary winding n1 of the control transformer Tr2 for the push-pull inverter is in series with the secondary winding n3 of the power transformer TR1 in the series resonance circuit. This connection passes the output current over the primary winding n1 of the control transformer Tr2, thus resulting in continuous matching of the transistor control to the load conditions. By changing the time constant of the control circuit of the inverter, stabilization of the lamp power under changing operating current is obtained and, additionally, substantially enhanced starting current can be obtained by use of the further transistor Tr5. The stabilization and starting current increase circuit includes the transistor T3, the emitter-collector path of which is connected in parallel to the overall resistance component of the control circuits for the inverter.

It is not strictly necessary that the lamp contain mercury; if the lamp fill includes xenon, mercury may be dispensed with. It is not necessary that the fill contain only xenon; a proportion of xenon to other noble gases of at least 50%, and preferably much higher, is suitable.

Various changes and modifications may be made within the scope of the inventive concept.

We claim:

1. An illumination system comprising the combination of a low-power high-pressure discharge lamp (1) with a power supply (S) connected to said discharge lamp wherein the power supply (S) supplies ignition or run-up current to the lamp which is between 5 to 10 times the nominal rated current of the lamp; and wherein the lamp (1) comprises a transparent discharge vessel (2);

electrode leads (5, 6) extending into and sealed into the discharge vessel;

electrodes (4) secured to the electrode lead-ins, spaced from each other and having portions defining a discharge space therebetween;

a fill in the discharge vessel including at least one noble gas, optionally mercury, and metal halides wherein said metal halides consist essentially of sodium and a rare earth metal halide or of sodium and a scandium halide, wherein the lamp further comprises the characteristics that the mass, in grams, of the discharge vessel per unit of rated power of the lamp, in watts, is between about 0.002 and 0.1 grams per watt;

the noble gas fill comprises xenon at a cold fill pressure of at least 3 bar;

the electrode shafts have a diameter, at the most, of 0.3 mm; and the electrode end portions facing said discharge space or gap are rounded.

2. The system of claim 1, wherein said discharge vessel includes, in part, a dichroic coating (9) which reflects invisible radiation while transmitting visible radiation.

3. The system of claim 2, wherein said coating (9) comprises: $SiO_2$ and $TiO_2$ or $SiO_2$ and $Si_3N_4$.

4. The system of claim 2, wherein the dichroic coating (9) has a thickness in the range of between about 0.1 to 1.5 μm.

5. The system of claim 1, wherein the discharge vessel, at least in part, is doped with a material absorbing invisible radiation while transmitting visible radiation.

6. The system of claim 5, wherein said doping material comprises at least one of: $TiO_2$, $CeO_2$, $SnO_2$ or $BaMgAl_2O_3$.

7. The system of claim 5, wherein the doping, by weight, is present in the amount of 0.02% to 0.2%, per unit weight of the material of the discharge vessel.

8. The system of claim 1, wherein the discharge vessel is formed with end portions adjacent a pinch or press seal (3) through which said electrode lead-ins extend, said end portions of the discharge vessel having a coating of zirconium dioxide for reflecting both visible and invisible radiation upon operation of the lamp.

9. The system of claim 8, further including a coating comprising silicon iron oxide in addition to the coating of zirconium dioxide.

10. The system of claim 1, wherein the power supply (S) comprises a self-oscillating push-pull inverter having two electronic switches (T1, T2) and a control transformer (Tr2) coupled to said electronic switches to form a self-starting oscillator circuit;

a series resonance circuit connected in parallel to an output of the oscillator circuit and including the series circuit of a resonance inductance (L1) and a resonance capacitor (C3); and a power transformer (Tr1) coupled to transmit high-frequency oscillations of the push-pull inverter circuit into the series resonance circuit;

wherein a primary winding (n1) of the control transformer (Tr2) for the inverter is connected in series with a secondary winding (n3) of the power transformer (Tr1) in the series resonance circuit.

11. The system of claim 10, further including circuit means (T3, T4, T5) coupled to the oscillator circuit to change the time constant of the oscillator circuit and hence the frequency of the push-pull oscillator.

12. The system of claim 10, wherein the electronic switches comprise high-speed power transistors (T1, T2).

13. The system of claim 12, wherein the control electrodes of the power transistors (T1, T2) are connected through secondary windings (n2, n3) of the control transformer (Tr2), and said control transformer comprises a center tap (A) of the secondary windings which center tap is common to said secondary windings (n2, n3).

14. The system of claim 13, wherein said center tap (A) of the secondary windings(n2, n3) of the control transformer (Tr2) is connected to one of the power terminals (L12; C) of a d-c power connection (L11, L12) for the inverter through a diode (D3) and a resistor (R1) serially connected with the diode.

15. The system of claim 14, further including circuit means (T3, T4, T5) coupled to the push-pull oscillator circuit to change the time constant of the oscillator circuit and hence the frequency of the push-pull oscillator, said circuit comprising a resistance control transistor (T3) having its emitter-collector path connected in parallel to the serially connected diode (D3) and resistor (R1) in the oscillator circuit, and wherein the emitter of the resistance control transistor (T3) is connected to said center tap (A) of the control transformer (Tr2) secondary.

16. The system of claim 15, further including a control circuit for said resistance control transistor (T3) said control circuit comprising means (P1, R3) sensing supply voltage across the input supply (L11, L12);

and connection means including a series circuit comprising a coupling resistor means (R6, R4) and a Zener diode (D7), serially connected with said resistor means, and connected to the emitter of the resistance control transistor (T3).

17. The system of claim 16, further including a first control transistor (T4) having its collector-emitter connected in parallel to the base and one of the main electrodes of said resistance control transistor (T3), the base of the first control transistor (T4) being connected to a junction (D) between said resistor means (R6, R4) and the Zener diode (D7).

18. The system of claim 15, further including a second control transistor (T5) having its collector-emitter path connected in parallel between the base and one of the main electrodes of the resistance control transistor and coupling circuit means connecting the base of the second control transistor to the oscillator circuit of said electronic inverter.

19. The system of claim 18, wherein said coupling circuit means comprises a coupling resistor (R5) connected to the center tap (A) between the secondary windings (n2, n3) of the control transformer (Tr2).

20. The system of claim 18, wherein said coupling circuit means comprises a diode rectifier circuit (D4, D5, D6) and a smoothing capacitor (C5); and a capacitative voltage divider (C3, C4) formed, in part, by said resonance capacitor (C3) and a further capacitor (C4) serially connected with said resonance capacitor (C3) and defining a connecting junction (E) therebetween, said connecting junction (E) being connected through said diode rectifier circuit to the base of said second control transistor (T5).

21. The system of claim 1, wherein the discharge vessel, at least in part, reflects or absorbs invisible radiation and transmits visible radiation.

* * * * *